US006276528B1

(12) United States Patent
Nowotny et al.

(10) Patent No.: US 6,276,528 B1
(45) Date of Patent: Aug. 21, 2001

(54) TUBULAR CORE ASSEMBLY WITH INTERLOCKING END MEMBERS AND SYSTEM FOR USE THEREOF TO WIND A CONTINUOUS WEB

(75) Inventors: Robert Nowotny, Calhoun; Ray Elrod, Dalton, both of GA (US)

(73) Assignee: Continental Products, Dalton, GA (US)

( * ) Notice: Subject to any disclaimer, the term of this patent is extended or adjusted under 35 U.S.C. 154(b) by 0 days.

(21) Appl. No.: 09/412,398

(22) Filed: Oct. 5, 1999

(51) Int. Cl.[7] ..... B65D 85/66
(52) U.S. Cl. ..... 206/397; 206/407; 220/8
(58) Field of Search ..... 206/38, 38.1, 39.6, 206/397, 398, 403, 404, 407, 410, 415, 416; 220/8, 23.91

(56) References Cited

U.S. PATENT DOCUMENTS

| | | | | |
|---|---|---|---|---|
| 368,471 | * | 8/1887 | Hargaves | 206/38 |
| 879,635 | * | 2/1908 | Harris | 206/38 |
| 1,352,238 | * | 9/1920 | Arthur | 220/8 |
| 4,046,279 | * | 9/1977 | Rosler | 220/8 |
| 4,596,340 | * | 6/1986 | Luther | 220/8 |
| 4,662,535 | * | 5/1987 | Loveland | 206/419 |
| 4,792,451 | * | 12/1988 | Kim | 220/8 |
| 4,875,636 | | 10/1989 | Kewin . | |
| 5,340,050 | | 8/1994 | Renck . | |
| 5,393,010 | | 2/1995 | Renck . | |
| 5,469,619 | | 11/1995 | Renck . | |
| 5,605,242 | * | 2/1997 | Hwang | 220/8 |
| 5,680,949 | * | 10/1997 | Roesler | 220/8 |
| 5,829,591 | * | 11/1998 | Lyons | 220/8 |

* cited by examiner

*Primary Examiner*—Paul T. Sewell
*Assistant Examiner*—Shian Luong
(74) *Attorney, Agent, or Firm*—Miles & Stockbridge P.C.; Edward J. Kondracki

(57) ABSTRACT

A tubular core assembly and system including a rigid, open ended, tubular core body having grip strips arranged in a pattern on the outer surface of the tubular core body, at least one circumferential locking area, and a pair of annular insert members each configured to be received within respective opposed ends of the tubular core body. Upon engagement of an annular insert member with an end of the tubular core body, at least one radially extending member integrally formed on an external peripheral surface of the insert member, becomes releasably interlocked with the locking area, and one or more other radially extending members become frictionally engaged with an inner surface of the tubular core body. The pattern of the grip strips is configured such that when sheet material disposed in a first wrap around the tubular outer surface frictionally engages the grip strips, the first wrap remains releasably retained and successive wraps of the sheet material are disposed in a tightly rolled configuration. The assembly further includes an over-wrap arranged to encase a roll of sheet material wrapped around the tubular core body so that opposing ends of the over-warp are each releasably retained in a pinching engagement between a respective annular insert member and the tubular core body.

20 Claims, 4 Drawing Sheets

TUBULAR CORE ASSEMBLY WITH INTERLOCKING END MEMBERS AND SYSTEM FOR USE THEREOF TO WIND A CONTINUOUS WEB

BACKGROUND OF THE INVENTION

1. Field of the Invention

The present invention relates to a tubular core assembly of the type used for winding continuous webs such as, for example, roll carpet or other forms of web material such as plastic film, newsprint and the like. More particularly, the invention relates to a tubular core assembly having mechanically interlocked end members, or inserts, facilitate the retention of a protective overwrap material used to protect the material wound upon a core.

2. Description of Related Art

U.S. Pat. No. 5,393,010 discloses a tubular core assembly for winding or unwinding sheet material, including inside diameter-reducing annular insert members at opposed ends of the tubular core. Each annular insert member is mechanically interlocked to the tubular core by at least one axial groove in the bodywall of the tubular core, which is arranged to engage an axially extending tongue member on an annular insert member.

U.S. Pat. No. 5,340,050 also discloses a similar tubular core assembly, wherein inside diameter-reducing annular insert members are mechanically locked to the tubular core by at least one radially extending pin.

U.S. Pat. No. 4,875,636 discloses a tubular core assembly that includes end caps, or plugs, arranged to be press-fit into the core to prevent damage to the end portions of the core. The core plugs include an outside lip area to aid in removal of the core plugs from the tubular core.

SUMMARY OF THE INVENTION

The present invention provides a tubular core assembly and system. The system includes a rigid, open ended, tubular core body, a pair of annular insert members, an over-wrap, an installation tool and a removing tool. The tubular core assembly includes the tubular core body, which has grip strips arranged in a pattern on its outer surface, and at least one circumferential locking area adjacent each end of the tubular core body, and a pair of annular insert members each configured to be received within respective opposed ends of the tubular core body.

Each insert member includes a plurality of radially extending members integrally formed on an external peripheral surface of the insert member and configured to be received in one or more circumferential locking areas of the tubular core body. Upon engagement of an insert member with an end of the tubular core body, one or more of the radially extending members become releasably interlocked with the locking area, and one or more other radially extending members become frictionally engaged with an inner surface of the tubular core body.

The grip strips may be arranged in any pattern, and preferably in either as straight strips oriented parallel to the long dimension of the tubular core body, or in a helical pattern, generally wrapping around the tubular core body. The grip strips may be made of any material which satisfies the function of frictionally engaging the first wrap of a continuous web adapted to be rolled about the tubular core body.

The tubular core assembly further includes an over-wrap, such as, for example, a plastic sheet material, arranged to encase a roll of sheet material wrapped around the tubular core body so that opposing ends of the over-warp are each releasably retained in a pinching engagement between a respective annular insert member and the inside wall of the tubular core body.

BRIEF DESCRIPTION OF THE DRAWINGS

The above and other features of the present invention and the attendant advantages will be readily apparent to those having ordinary skill in the art and the invention will be more easily understood from the following detailed description of the preferred embodiments of the present invention, taken in conjunction with the accompanying drawing.

DESCRIPTION OF THE PREFERRED EMBODIMENTS

Figure 1:
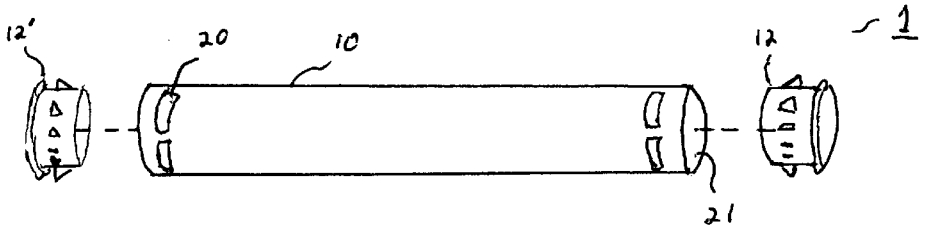
FIG. 1 is a schematic illustration of tubular core assembly 1, according to the present invention.

FIG. 1 is a schematic illustration of tubular core assembly 1, according to the present invention, showing an elongate hollow cylindrical member or tubular core body 10 and a pair of annular insert members 12, 12', each oriented to be received by opposing ends of tubular core assembly 1. Tubular core body 10 can be made of any rigid material that can be configured with a slot having a profile that retains one of the annular insert members 12, 12', as described in more detail, below. Preferably, tubular core body is 10 is made of polypropylene, but other materials can be used to form the core body such as, for example, plastic, recycled plastic, or similar materials, by molding or extrusion. Multiple layer tubular bodies formed by a conventional convolute wrapping process can also be used.

Figure 2:
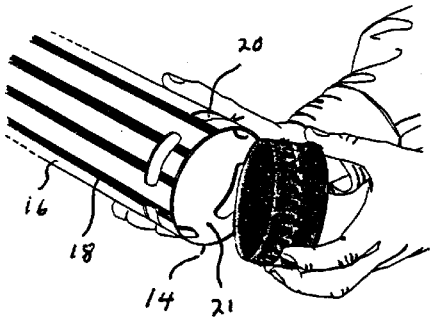
FIG. 2 is a schematic illustration of the manner in which the core assembly is formed, according to the present invention.

FIG. 2 is a schematic illustration of the manner in which the core assembly is formed. A user holding an annular insert member 12 positions member 12 for assembly into one end of tubular core body 10. Tubular core body 10 includes a bodywall 14 having an outer surface 16, grip strips 18 arranged in a pattern on outer surface 16, and at least one circumferential slot 20 adjacent to each end.

Figure 3:
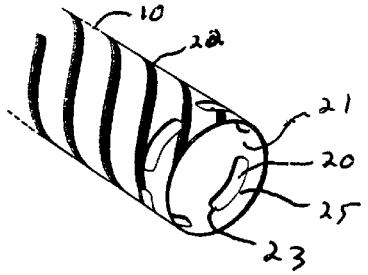
FIG. 3 is a schematic illustration of the tubular core body including gripping strips arranged in a helical pattern, according to the present invention.

Grip strips 18 may be arranged in any convenient pattern extending between opposing ends of the tubular core body 10, so that sheet material, for example, a continuous carpet web, disposed in a first wrap around the tubular outer surface 16 frictionally engages the grip strips 18. In this manner, the first wrap is releasably retained on the core body 10 and successive wraps of the sheet material are wrapped about the core body 10 in a tightly rolled configuration. The pattern can be one of straight strips oriented parallel to the long dimension of the tubular core body, as shown in FIG. 2, or a helical pattern, with strips 22 arranged in a spaced relation to one another, as shown in FIG. 3. The grip strips 18 and 22 are manufactured by any number of methods. As non-limiting examples, grip strips 18 and 22 are made of synthetic or natural material and are applied to the outer surface of the tubular core body 10 by co-extrusion, spray, or hand application. Preferably, grip strips 18 and 22 are co-extruded and made of thermal plastic rubber. Any pattern of grip strips 18 and 22 is suitable and various materials may be used which satisfy the function of frictionally engaging the first wrap of a continuous web adapted to be rolled about the tubular core body 10.

Figure 3A:
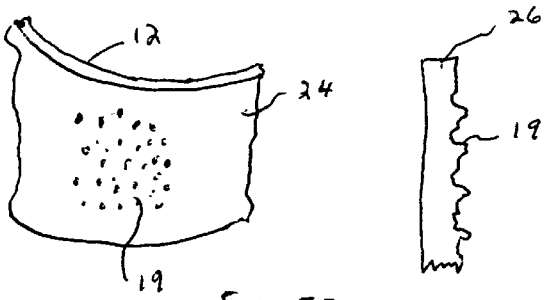
FIG. 3A is a schematic illustration of radially extending tongue members in the form of a knurled pattern according to the present invention.

Alternatively, grip strips 18, 22 may be a knurled pattern, as schematically illustrated in FIG. 3A. FIG. 3A schematically illustrates a portion of annular end insert member 12, including exterior periphery 24, which includes a knurled pattern 19, i.e., a plurality of raised portions produced by a knurling process. Also shown, is a cross-sectional view of member 12, revealing the raised portions of the periphery 24.

Figure 4:
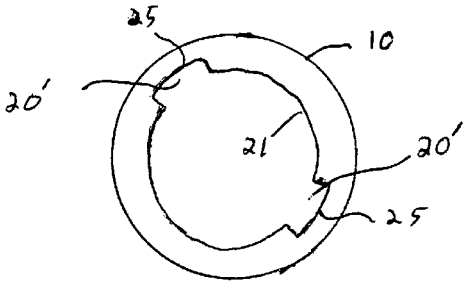
FIG. 4 is a schematic cross-sectional view of the tubular core body including circumferential cooperative locking areas extending partially through the bodywall, according to the present invention.

Tubular core body 10 may be configured to have one or more circumferential cooperative locking areas 20 integrally formed in the bodywall 14 adjacent to a respective end of body 10. Circumferential cooperative locking areas 20 may have any convenient shape, and typically, but not by way of limitation, areas 20 are through slots substantially rectangular or oblong in shape, which are milled, punched, or cast into bodywall 14. The shape and dimensions of slots 20 are determined by the dimensions, spacing, and profile of radially extending tongue members 26. Circumferential cooperative locking areas 20 can extend from inner surface 21 to a depth partially through bodywall 14 so as to form a groove 20' in the internal wall, as shown in FIG. 4, however, preferably, areas 20 have a depth extending completely through the bodywall to form spaced slots along the periphery of the core body 10 adjacent each end, as shown in FIG. 3.

Figure 5:
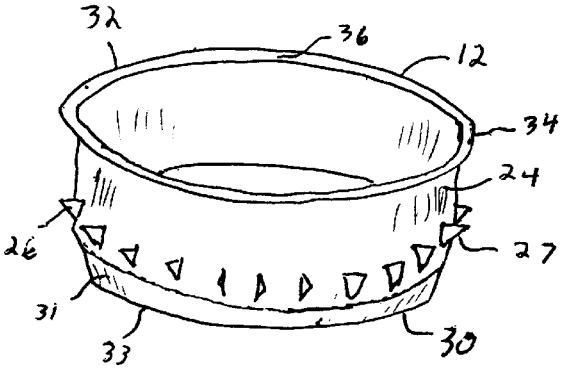
FIG. 5 is a schematic illustration of an annular insert member according to the present invention.

FIG. 5 is a schematic illustration of annular insert member 12, which is identical to end insert member 12'. Annular insert members 12, 12' have a cylindrical exterior periphery 24 with a diameter slightly less than that of core body 10, and are configured to be received by respective ends of tubular core body 10 in coaxial relation therewith. Annular insert members 12, 12' preferably are resiliently deformable, thereby facilitating removal after assembly with an end of tubular core body 10, thereby enabling repeated reuse without sustaining substantial damage resulting from the removal step. Preferably, end insert members 12, 12' are made of polypropylene, but other materials can be used, including recycled plastic. At least one, and preferably a plurality, of radially extending tongue members 26 are integrally formed on cylindrical exterior periphery 24, and are configured to interlock with circumferential locking areas or slots 20 when annular insert members 12, 12' are pressed into respective ends of tubular core body 10. Preferably, the interlocking engagement between annular insert member 12 and tubular core body 10 is releasable.

Figure 6:
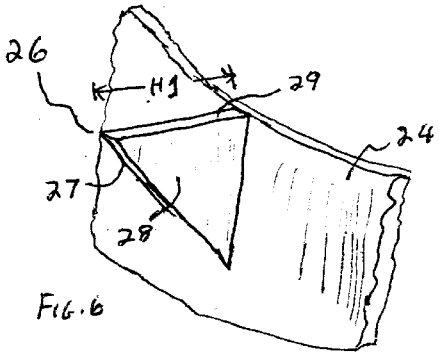
FIG. 6 is a schematic illustration of a radially extending tongue member according to the present invention.

FIG. 6 is a schematic illustration of a radially extending tongue member 26 extending from exterior periphery 24. Tongue member 26 includes a cam surface 27 extending outward from periphery 24 and has a cam profile configured for camming engagement with an inner surface 21 of tubular core body 10. Cam surface 27 is configured to provide assistance during insertion of annular insert member 12 into an end of tubular core body 10. Preferably, the cam profile includes a slope from an initial height H1 downward to the exterior periphery 24 of the annular insert member 12. The direction of the slope facilitates easy assembly of end insert member 12 into core body 10, because, when pressed together, the camming effect of cam surface 27 resiliently deforms either tongue member 26 or periphery 24, depending on selection of materials and dimensions. Preferably, surface 28 is substantially perpendicular to exterior periphery 24 and is configured for locking engagement with an end wall 23 of one of the circumferential cooperative locking areas 20, thereby preventing rotation of the annular insert member 12 with respect to the tubular core body 10. Preferably, surface 29 is also substantially perpendicular to exterior periphery 24, so that upon assembly, surface 29 abuts a circumferential wall 25 of the locking area 20.

Figure 7:
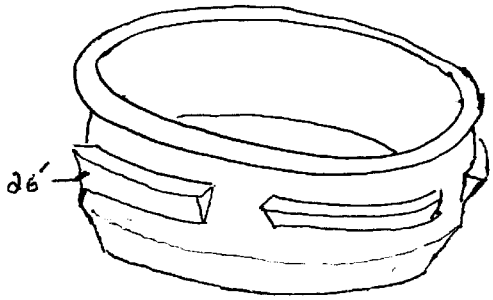
FIG. 7 is a schematic illustration of a radially extending tongue member in the form of spaced, circumferential segments according to the present invention.

FIG. 7 schematically illustrates an alternative embodiment, in which radially extending tongue member 26 is in the form of spaced segments 26' extending circumferentially along the peripheral surface 24. Each segment 26' has a cam profile configured for ease of assembly and for locking engagement with a respective circumferential locking area or slot 20. Preferably, each segment 26' is keyed to one corresponding area or slot 20 and extends substantially along the entire length thereof.

Figure 8:
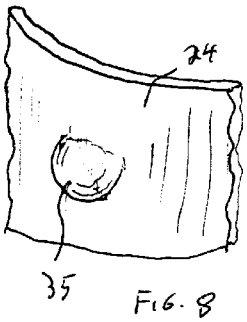
FIG. 8 is a schematic illustration of a radially extending tongue member in the form of a dimple according to the present invention.

FIG. 8 schematically illustrates an alternative embodiment having a substantially half-spherical cam profile, as a dimple raised above exterior periphery 24 of annular insert member 12.

The radially extending tongue members 26 are preferably deformable to a certain extent to allow insertion of the end insert members 12, 12' into the core body 10, regardless of the specific cam profile employed. Alternatively, end insert members 12, 12' are sufficiently deformable to allow this insertion. Sliding engagement of the radially extending tongue member 26 with inner surface 21 of tubular core body 10 causes certain tongue members 26, or alternatively, portions of end insert member 12, 12', to temporarily deform until they seat and extend into the circumferential slots 20, and return to, or nearly to, their original profile. Those tongue members 26 that are not aligned in a slot, press against inner surface 21 and frictionally retain the end insert member 12, 12' in position.

Again referring to FIG. 5, annular insert member 12 further includes a leading end 30 and a trailing end 32. Each end 30 and 32 has a face oriented perpendicular to cylindrical exterior periphery 24 of end insert member 12.

Trailing end 32 includes a lip 34 forming a circumferentially extending lip wall 36 oriented perpendicular to the exterior cylindrical periphery 24. In use, when annular insert member 12 is pressed completely into interlocking engagement with one end of tubular core body 10, the lip wall 36 abuts the end of tubular core body 10. Leading end 30 further includes a beveled surface 31 having a leading edge 33 with a diameter smaller than the diameter of the cylindrical core body 10. Beveled surface 31 thus functions to assist in assembly of annular insert member 12 into an end of tubular core body 10.

Figure 9:
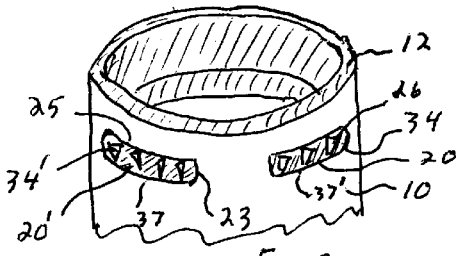
FIG. 9 is a schematic illustration of the annular insert member completely seated in one end of the tubular core body according to the present invention.

FIG. 9 schematically illustrates the tubular core assembly 1 with an annular insert member 12 completely seated in one end of tubular core body 10. Several groupings, represented by groupings 37 and 37', of radially tongue members 26 are shown engaged in, and protruding through respective circumferential slots 20 and 20'.

Figure 10:
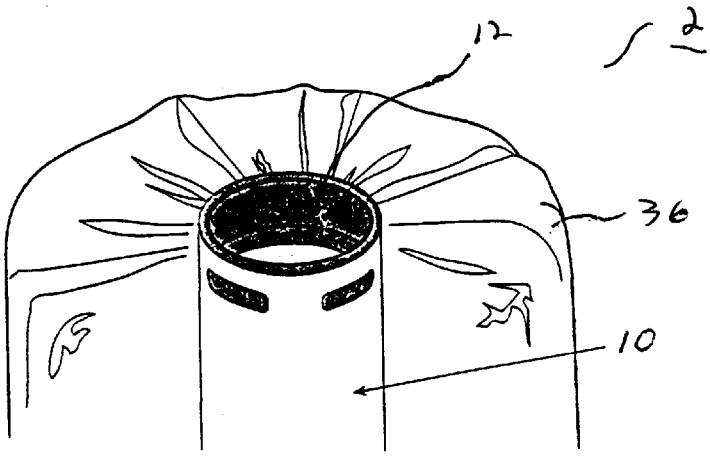
FIG. 10 is a schematic illustration of one end of the tubular core assembly including an over-wrap according to the present invention.

FIG. 10 is a schematic illustration of one end of a tubular core assembly 1, which according to the present invention, operates in conjunction with an over-wrap 36 adapted to protectively encase a roll of sheet material, such as a carpet web, carried on tubular core body 10. Over-wrap 36 can be any paper, plastic, cloth or other sheet material having a general shape, preferably a rectangular shape, which allows it to be wrapped about the carpet web or other material carried on the core body 10 and to be protected from external elements and possible damage. Each of two opposing ends of over-wrap 36 is arranged to be releasably retained in a pinching engagement between a respective annular insert member 12, 12' and tubular core body 10. To this end, the over-wrap 36, after being wrapped about the web material, is inserted into the free ends of core body 10, after which an insert 12, 12' is pressed into the core body 10, trapping or capturing the over-wrap 36 in place.

Figure 11:
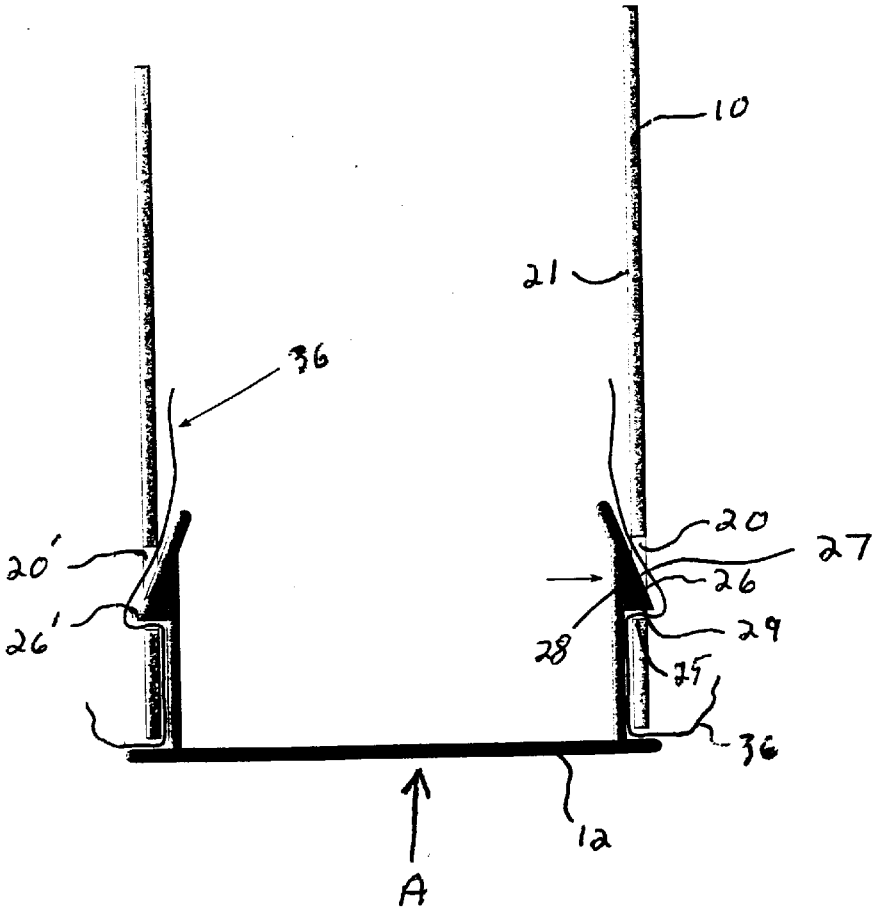
FIG. 11 is a cross-sectional schematic view of one end of tubular core assembly according to the present invention.

FIG. 11 is a cross-sectional schematic view of one end of tubular core assembly 2, showing tubular core body 10 and annular insert member 12, including radially extending tongue members 26 and 26' in seated, locking engagement with respective circumferential slot 20 or optionally, groove 20'. Over-wrap 36 is shown as captured between annular insert member 12 and tubular body member 12.

FIG. 11 also shows a cross-sectional view of sloping cam surface 27 of tongue member 26 in cooperation with circumferential slot 20, when end insert member 12 is completely engaged in core body 10. When end insert member 12 is moved in the direction of arrow A, i.e., in an insertion direction into tubular core body 10, sloping surface 27 contacts inner surface 21 of core body 10 first, thereby forcing resilient deformation of either the tongue member 26 or the end insert member 12, so that end insert member 12 travels therein until completely engaged, as illustrated in FIG. 11. Whether tongue member 26 or end insert member 12 deforms depends on selection of materials and dimensions. When completely engaged, whichever of tongue member 26, or end insert member 12 that sustained resilient deformation, returns to substantially its original shape, and surface 29 remains abutted against circumferential locking slot wall 25. Further, as described in connection with FIGS. 6 and 9, surface 28 is substantially perpendicular to exterior periphery 24 of end insert member 12 and is configured for locking engagement with an end wall 23 of one of the circumferential cooperative locking areas 20, thereby preventing rotation of the annular insert member 12 with respect to the tubular core body 10.

Figure 12:
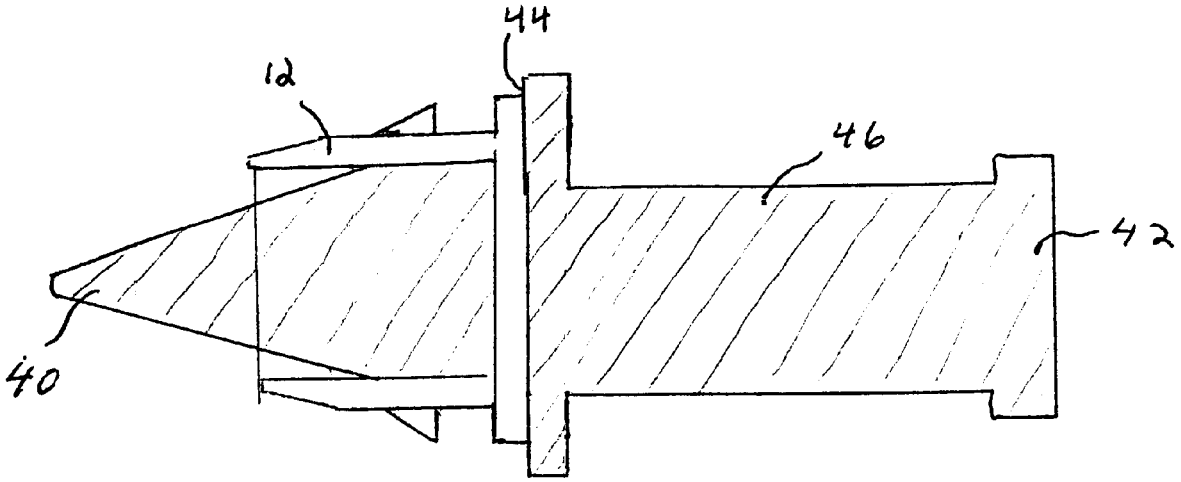
FIG. 12 is a schematic illustration of the installation tool engaged in an annular end insert member according to the present invention.

FIG. 12 is a schematic illustration of a preferred embodiment of an installation tool 38 shown in engagement with annular insert member 12. Tool 38 includes a first end 40 and second end 42, an annular shoulder 44 disposed therebetween in coaxial relation therewith, and a handle portion 46 disposed between the annular shoulder 44 and the second end 42. The first end 40 is configured to be operatively inserted in an annular insert member 12, and annular insert member 12 together with tool 38 are configured to be inserted into tubular core body 10. Second end 42 is configured operatively to receive driving impacts, so that during use, the handle portion 46 is held so as to locate first end 40 inside an annular insert member 12 so that annular shoulder 44 abuts annular raised lip 34 of annular insert member 12, so that when second end 42 is impacted, tool 38 drivingly seats annular insert member 12 into seated engagement with tubular core body 10.

Figure 13:
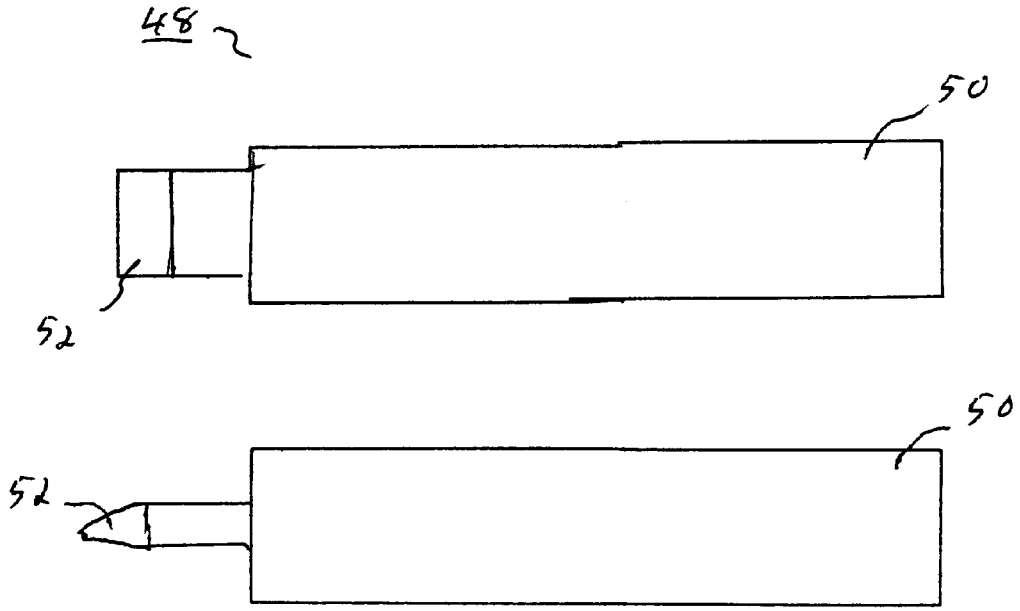
FIG. 13 is a schematic illustration of side and end views of the removing tool according to the present invention.

FIG. 13 is a schematic illustration of a removing tool 48, including a handle end 50 configured for gripping and an opposing chisel end 52 having a chisel-like profile. In use, handle end 50 is gripped so as to orient chisel end 52 in a gap formed at the juncture between the outer lip 34 of annular insert member 12 and the inner surface of tubular core body 10. Upon prying manipulation of tool 38, the annular insert member 12 may be separated from tubular core body 10. Advantageously, this separation occurs as a result of appropriate selection of materials and dimensions of the interlocked components, thereby enabling the annular insert member 12 to be resiliently deformed until completely disengaged from core body 10. Disengagement of end insert member 12 from core body 10 results after vertical wall 29 becomes fully disengaged from wall 25 of cooperating circumferential slot 20. As a result, both end insert member 12 and core body 10 sustain little, or no, damage when separated, and can be repeatedly re-used, thereby providing cost savings.

While this invention has been described in conjunction with specific embodiments thereof, it is evident that many alternative modifications and variations will be apparent to those skilled in the art. Accordingly, the preferred embodiments of the invention as set forth herein are intended to be illustrative, not limiting. Various changes may be made without departing from the true spirit and scope of the invention as defined in the following claims.

What is claimed is:

1. A tubular core assembly for a roll of sheet material comprising:

an elongate hollow cylindrical tubular core body comprising a bodywall having an outer and inner surface, said tubular core body having at least one circumferential slot integrally formed in said bodywall, extending through said bodywall;

annular insert members, said annular insert members each having a cylindrical exterior periphery and configured to be inserted and received into respective ends of said tubular core body in coaxial relation therewith; and a plurality of spaced, outwardly extending tongue members integrally formed on said cylindrical exterior periphery of each of said annular insert members and configured to be received in said slots of said tubular core body in interlocking relationship therewith, whereupon engagement of said annular insert members with respective ones of said opposing ends of said tubular core body results in said at least one radially extending tongue member being received in interlocking engagement with said at least one circumferential slot and at least one other radially extending tongue member being received in frictional engagement against the inner surface of said bodywall to frictionally retain said inserted annular insert member in place.

2. The tubular core assembly of claim 1 wherein said interlocking engagement is releasable.

3. The tubular core assembly of claim 1 wherein said at least one radially extending tongue member includes a sloping surface extending from an initial height downward in the direction of a leading end of said annular insert member to the exterior periphery of the annular insert member, said sloping surface being contiguous with a flat locking surface substantially perpendicular to said exterior periphery and configured for releasably locking engagement with a side wall of one of the circumferential slots, and a side surface for locking engagement with an end wall of one of the circumferential slots so as to prevent rotation of the annular insert member with respect to the tubular core body.

4. The tubular core assembly of claim 1 wherein said at least one radially extending tongue member is resiliently deformable, whereupon sliding engagement of said at least one radially extending tongue member with the inner surface of said tubular core body causes said at least one first radially extending tongue member to temporarily deform until said at least one first radially extending tongue member seats in releasably locking engagement with one of said at least one circumferential slots, while at least one second radially extending tongue member resiliently deforms and is maintained in frictional engagement with the inner surface of said tubular core body.

5. The tubular core assembly of claim 1 further comprising:

grip strips arranged in a pattern on said outer surface of said bodywall and extending between opposing ends of said tubular core body.

6. The tubular core assembly of claim 5 wherein said pattern comprises one of spaced strips oriented parallel to the longitudinal axis of the tubular core body, spiral strips defined by strips arranged in a spaced relation to one another in a generally helical pattern around the tubular core body, or a knurled surface.

7. The tubular core assembly of claim 5 wherein said grip strips are one of a synthetic or natural material disposed on the outer surface of the tubular core body as one of a co-extrusion, spray, or hand application.

8. The tubular core assembly of claim 5 wherein said tubular core body is made of polypropylene and said co-extruded grip strips are made of thermal plastic rubber.

9. A tubular core assembly for a roll of sheet material comprising:

an elongate hollow cylindrical tubular core body comprising a bodywall having an outer and inner surface, said tubular core body having at least one circumferential slot integrally formed in said bodywall, extending through said bodywall;

annular insert members, said annular insert members each having a cylindrical exterior periphery and configured to be inserted and received into respective ends of said tubular core body in coaxial relation therewith;

a plurality of spaced, outwardly extending tongue members integrally formed on said cylindrical exterior periphery of each of said annular insert members and configured to be received in said slots of said tubular core body in interlocking relationship therewith, whereupon engagement of said annular insert members with respective ones of said opposing ends of said tubular core body results in said at least one radially extending tongue member being received in interlocking engagement with said at least one circumferential slot and at least one other radially extending tongue member being received in frictional engagement against the inner surface of said bodywall to frictionally retain said inserted annular insert member in place;

wherein said at least one radially extending tongue member includes a sloping surface for camming engagement with the inner surface of said tubular core body upon insertion of said end insert member into an end of the tubular core body; and locking surfaces including a vertical back edge for preventing withdrawal of said end insert member from said core body and a vertical side wall for preventing rotation of said end insert member with respect to said core body.

10. The tubular core assembly of claim 9 wherein each said at least one radially extending tongue member comprises one of a circumferential arrangement of spaced outwardly extending elongated segments, each said segment having a sloping surface for insertion of the end insert member into the tubular body and for locking engagement with a respective one of said at least one circumferential slots, or an arrangement of substantially a half-spherical dimples.

11. The tubular core assembly of claim 7 wherein said interlocking engagement is releasable.

12. A tubular core assembly system comprising an elongate tubular core body having an outer surface and an inner surface and grip strips arranged in a pattern on the outer surface, a plurality of spaced slots adjacent opposite ends of said core body extending substantially therethrough, a pair of annular insert members each configured to be received within respective opposed ends of said tubular core body in coaxial relation therewith; and said annular insert members each including spaced radially extending deformable members integrally formed on an exterior periphery of the end insert member and configured to be received in said slots of said tubular core body in interlocking relationship therewith, whereupon engagement of said annular insert members with respective ones of said opposing ends of said tubular core body results in at least one first radially extending member achieving interlocking engagement with said at least one circumferential slot and at least one second radially extending member frictionally engaging the inner surface of said core body.

13. The tubular core assembly system of claim 12 wherein said at least one radially extending deformable member is resiliently deformable, whereupon sliding engagement of radially extending deformable members with the inner surface of said tubular core body causes said at least one first radially extending deformable member to temporarily deform until said at least one first radially extending deformable member seats in releasably locking engagement with one of said at least one circumferential slots, while at least one second radially extending deformable member resiliently deforms and is maintained in a frictional engagement with the inner surface of said tubular core body.

14. The tubular core assembly system of claim 12 wherein said pattern comprises one of strips oriented parallel to the longitudinal axis of the tubular core body and extending between opposing ends of said tubular core body, spiral strips arranged in a spaced relation to one another in a generally helical pattern around the tubular core body, or a knurled pattern including a plurality of raised portions of said outer surface of said tubular core body; and said grip strips are one of a synthetic or natural material disposed on the outer surface of the tubular core body as one of a co-extrusion, spray, or hand application.

15. The tubular core assembly system of claim 12, further including an over-wrap having opposing ends, said over-wrap adapted to encase a roll of sheet material wrapped around said tubular core body with each of said opposing ends releasably retained in a pinching engagement between a respective annular insert member and said tubular core body.

16. A tubular core assembly system comprising an elongate tubular core body having an outer surface and an inner surface and grip strips arranged in a pattern on the outer surface, a plurality of spaced slots adjacent opposite ends of said core body extending substantially therethrough, a pair of annular insert members each configured to be received within respective opposed ends of said tubular core body in coaxial relation therewith;

said annular insert members each including spaced radially extending deformable members integrally formed on an exterior periphery of the end insert member and configured to be received in said slots of said tubular core body in interlocking relationship therewith, whereupon engagement of said annular insert members with respective ones of said opposing ends of said tubular core body results in at least one first radially extending member achieving interlocking engagement with said at least one circumferential slot and at least one second radially extending member frictionally engaging the inner surface of said core body;

an installation tool, said tool having first and second ends, an annular shoulder disposed therebetween in coaxial relation therewith, and a handle portion disposed between said annular shoulder and said second end, said first end configured to be operatively inserted in one of said pair of annular insert members, said second end configured operatively to receive driving impacts, whereby in use, said handle portion is held so as to locate said first end inside an annular insert member so that said annular shoulder abuts an annular raised lip of said annular insert member, so that when said second end is impacted, said tool drivingly seats said annular insert member into seated engagement with said tubular core body.

17. The tubular core assembly system of claim 16 further comprising:

a removing tool, said removing tool including a handle end configured for gripping and an opposing chisel end, whereby in use, said handle end is gripped so as to orient said chisel end in a gap formed by a juncture between an annular insert member disposed in locking engagement with a tubular core body, whereupon prying manipulation of said tool results in separating said annular insert member from said tubular core body.

18. The tubular core assembly system of claim 16 wherein said at least one radially extending deformable member is resiliently deformable, whereupon sliding engagement of radially extending deformable members with the inner surface of said tubular core body causes said at least one first radially extending deformable member to temporarily deform until said at least one first radially extending deformable member seats in releasably locking engagement with one of said at least one circumferential slots, while at least one second radially extending deformable member resiliently deforms and is maintained in a frictional engagement with the inner surface of said tubular core body.

19. The tubular core assembly system of claim 16 wherein said pattern comprises one of strips oriented parallel to the longitudinal axis of the tubular core body and extending between opposing ends of said tubular core body, spiral strips arranged in a spaced relation to one another in a generally helical pattern around the tubular core body, or a knurled pattern including a plurality of raised portions of said outer surface of said tubular core body; and said grip strips are one of a synthetic or natural material disposed on the outer surface of the tubular core body as one of a co-extrusion, spray, or hand application.

20. The tubular core assembly system of claim 16, further including an over-wrap having opposing ends, said over-wrap adapted to encase a roll of sheet material wrapped around said tubular core body with each of said opposing ends releasably retained in a pinching engagement between a respective annular insert member and said tubular core body.

* * * * *